US007404595B2

(12) United States Patent
Mori

(10) Patent No.: US 7,404,595 B2
(45) Date of Patent: Jul. 29, 2008

(54) CONSTRUCTION MACHINE AND PROJECTING OBJECT OF THE SAME

(75) Inventor: Tadashi Mori, Settsu (JP)

(73) Assignee: Komatsu Ltd., Tokyo (JP)

( * ) Notice: Subject to any disclaimer, the term of this patent is extended or adjusted under 35 U.S.C. 154(b) by 117 days.

(21) Appl. No.: 10/562,810

(22) PCT Filed: Jun. 24, 2004

(86) PCT No.: PCT/JP2004/009271

§ 371 (c)(1),
(2), (4) Date: Dec. 29, 2005

(87) PCT Pub. No.: WO2005/003468

PCT Pub. Date: Jan. 13, 2005

(65) Prior Publication Data

US 2006/0158006 A1 Jul. 20, 2006

(30) Foreign Application Priority Data

Jul. 1, 2003 (JP) ..... 2003-270006

(51) Int. Cl.
*E02F 9/16* (2006.01)

(52) U.S. Cl. ..... 296/190.03; 296/190.041; 296/190.08

(58) Field of Classification Search ..... 296/190.01, 296/190.08, 190.03, 190.04; 37/347
See application file for complete search history.

(56) References Cited

U.S. PATENT DOCUMENTS 6,155,632 A * 12/2000 Fujimoto ..... 296/190.08
6,769,732 B2 * 8/2004 Sakyo ..... 296/190.03
2002/0149232 A1 * 10/2002 Sakyo et al. ..... 296/190.08

FOREIGN PATENT DOCUMENTS

| | | | |
|---|---|---|---|
| JP | 64-009083 | A | 1/1989 |
| JP | 9-154336 | A | 6/1997 |
| JP | 9-240402 | A | 9/1997 |
| JP | 10-114252 | A | 5/1998 |
| JP | 10-324210 | A | 12/1998 |
| JP | 11-61885 | A | 3/1999 |
| JP | 2000-230255 | A | 8/2000 |
| JP | 2001-173017 | A | 6/2001 |

* cited by examiner

*Primary Examiner*—Dennis H Pedder
(74) *Attorney, Agent, or Firm*—Frishauf, Holtz, Goodman & Chick, P.C.

(57) ABSTRACT

A construction machine and a projecting member thereof are provided which can be manufactured at low cost and restrict deformation of an operator's cab without impairing visibility in case of tumbling of the construction machine. To this end, there are provided, on a revolving superstructure frame (3), a work implement (30) located on the cross-wise mid position of a front part, a counterweight (7) located at a rear part and an operator's cab located at either the right or left side of the front part. At least one of the revolving superstructure frame, the work implement and the counterweight is provided with a projecting member (31-38) that projects outward. An operator's cab space (10*a*, 20*a*) is kept in an inner position of a vehicle body compared to a virtual plane defined by the at least one projecting member and positions where no projecting members are provided.

1 Claim, 12 Drawing Sheets

CONSTRUCTION MACHINE AND PROJECTING OBJECT OF THE SAME

This application is a U.S. National Phase Application under 35 USC 371 of International Application PCT/JP2004/009271 filed Jun. 24, 2004.

TECHNICAL FIELD

The present invention relates to a construction machine and a projecting member thereof, the construction machine being structured such that if the construction machine overturns ("overturn" is defined herein as a turn through approximately 90 degrees) or tumbles ("tumbling" is defined herein as a turn through approximately 180 degrees or more), an operator's cab space can be kept to allow the operator to work to repair and recover the construction machine.

BACKGROUND ART

In the field of construction machines, there have been heretofore proposed a variety of means for protecting the operator from overturn or tumbling of a construction machine by restricting or preventing deformation of the operator's cab. One example of such means is disclosed in Japanese Unexamined Published Patent Application No. 2000-230255 (First Example). This publication describes, in pages 2 to 3 and FIG. 1, a structure for a construction machine in which an operator's cab is mounted on either the right or left side of a revolving superstructure frame which is mounted on the upper part of the lower traveling structure so as to be freely turnable. This publication also describes a supporting structure in which a supporting member is attached to a side face of the revolving superstructure frame on the side of the operator's cab such that if the construction machine turns over on the operator's cab side, the supporting member holds the construction machine in cooperation with the lower traveling structure so as to keep the operator's cab out of touch with the ground. The first example provides a means that is inexpensive and easily applicable to ordinary construction machines, but suggests no idea for protection if the construction machine does not stay in an overturned state but goes into tumbling.

Another means is disclosed in Japanese Unexamined Published Patent Application No. 2001-173017 (Second Example). This publication describes, in pages 4 to 5 and FIGS. 1 and 4, a protective structure according to which the operator's cab is enclosed by a cab guard constructed by a portal-shaped frame and the operator's cab is protected by the cab guard in case of tumbling of the construction machine. With reference to FIGS. 13 and 14, there will be explained one example of construction machines having a cab protecting structure according to the prior art. When the terms "right" and "left", are used herein, it should be understood that these terms have reference to the structure of the construction machine as it would appear to the operator looking forward from the vehicle (see FIG. 1).

Referring to FIGS. 13 and 14, a hydraulic excavator 80 is constructed such that a revolving superstructure frame 82 is mounted on a lower traveling structure 81 so as to be freely turnable. Mounted on the revolving superstructure frame 82 are a boom 83 for a work implement that is attached to the cross-wise mid position of the front part of the frame 82; a counterweight 84 that is located in the rear part of the frame 82; and an operator's cab 85 that is located in the left front part of the frame 82. A cab guard 90 encloses the operator's cab 85.

In the structure of the hydraulic excavator 80, the provision of the cab guard 90 enclosing the operator's cab 85 has revealed the following problem. The cab guard 90 is required to have an extremely strong structure in order to prevent or restrict deformation of the operator's cab 85 in the event of tumbling of the hydraulic excavator 80. For this reason, the cab guard 90 becomes extremely costly and an increase in the weight of the operator's cab leads to an increase in the total weight of the vehicle, resulting in a decrease in the operability of the vehicle. In addition, the visibility of the operator's cab 85 is interrupted by the cab guard 90, which leads to decreased work efficiency.

DISCLOSURE OF THE INVENTION

The present invention is directed to overcoming the foregoing problems and a primary object of the invention is therefore to provide a construction machine and a projecting member thereof, which carry out restriction of deformation of an operator's cab in the event of tumbling of the construction machine without causing increased weight and decreased visibility and which can be manufactured at low cost.

In accomplishing the above object, there has been provided, in accordance with a first aspect of the present invention, a construction machine comprising: a lower traveling structure; a revolving superstructure frame mounted on the lower traveling structure through a swivel so as to be freely turnable; a work implement mounted on the revolving superstructure frame, being located at a substantially cross-wise mid position of a front part of the revolving superstructure frame; a counterweight mounted on the revolving superstructure frame, being located at a rear part of the revolving superstructure frame; and an operator's cab mounted on the revolving superstructure frame, being located at either the right or left side of the front part of the revolving superstructure frame, wherein at least one of the revolving superstructure frame, the work implement and the counterweight is provided with a projecting member which projects outward, and wherein an operator's cab space is kept in an inner position of a vehicle body compared to a virtual plane, the virtual plane being defined by the projecting member disposed on at least one of the revolving superstructure frame, the work implement and the counterweight and positions where no projecting members are provided.

According to a second aspect of the present invention, there is provided a construction machine comprising: a lower traveling structure; a revolving superstructure frame mounted on the lower traveling structure through a swivel so as to be freely turnable; a work implement mounted on the revolving superstructure frame, being located at a substantially cross-wise mid position of a front part of the revolving superstructure frame; a counterweight mounted on the revolving superstructure frame, being located at a rear part of the revolving superstructure frame; and an operator's cab mounted on the revolving superstructure frame, being located at either the right or left side of the front part of the revolving superstructure frame, wherein an end of the revolving superstructure frame which end is located on the side of the operator's cab and an upper part of the counterweight which upper part is opposed to the rear face of the operator's cab are each provided with a projecting member that projects upward, and wherein a virtual plane does not intersect the space of the operator's cab in anywhere, the virtual plane being defined by the projecting member disposed on the revolving superstructure frame, the projecting member disposed on the counterweight and the work implement or a projecting member attached to the work implement so as to project upward or towards the side of the operator's cab.

According to the first and second aspects, in the event of tumbling, the construction machine is supported with the virtual plane being in contact with the ground, which virtual plane is defined by the respect ends of the revolving superstructure frame, work implement and counterweight or the projecting member attached to at least any one of the ends of these members. At that time, an operator's cab space where the operator can work to repair and recover the construction machine can be kept in an inner position of the vehicle body than the virtual plane is located. In this case, the projecting member can be manufactured at lower cost and is less heavier in weight, compared to the conventional cab guard. In addition, since the operator's cab is not enclosed by a cab guard, the visibility of the operator's cab can be increased. As a result, a lightweight structure, which can restrict deformation of the operator's cab in the event of tumbling of the construction machine, can be implemented at low production cost while keeping good visibility for the operator's cab.

In the construction machine according to the first aspect, the projecting member provided for the counterweight may be an upwardly projecting member disposed on an upper part of the counterweight which upper part faces the rear face of the operator's cab. The upwardly projecting member of this structure facilitates keeping of a large space as the operator's cab space that is located in the inner position than the location of the virtual plane. In addition, since the project area of the construction machine, which is obtained by projection from above, does not increase, the turn radius of the construction machine does not increase. Therefore, the invention can be applied to small-sized and middle-sized construction machines such as small trail radius hydraulic excavators without impairing their operability.

According to the invention, there is provided a projecting member for a construction machine which has a lower traveling structure; a revolving superstructure frame mounted on the lower traveling structure through a swivel so as to be freely turnable; a work implement mounted on the revolving superstructure frame, being located at a substantially crosswise mid position of a front part of the revolving superstructure frame; a counterweight mounted on the revolving superstructure frame, being located at a rear part of the revolving superstructure frame; and an operator's cab disposed on the revolving superstructure frame, being located at either the right or left side of the front part of the revolving superstructure frame, the projecting member being attached to at least one of the revolving superstructure frame, the work implement and the counterweight such that the leading end of the projecting member projects outward, an operator's cab space being kept in an inner position of a vehicle body compared to a virtual plane, the virtual plane being defined by the projecting member attached to at least one of the revolving superstructure frame, the work implement and the counterweight and positions where no projecting members are provided, and the projecting member attached to at least one of the revolving superstructure frame, the work implement and the counterweight being made of a welded structure, cast part or forged part and having a base end portion attached to at least any one of the revolving superstructure frame, the work implement and the counterweight.

In the above arrangement, since the projecting member is made of a welded structure, cast part or forged part, it can be universally, easily produced at low cost while the amount of projection such as configuration, thickness and length being adjusted according to the machine. Since the projecting member can be attached by bolting or welding while adjusting its mounting position, the interference with the components of the construction machine can be avoided and the visibility of the construction machine is not impaired. The projecting member can be separately formed without affecting the arrangement of any other components of the construction machine. In addition, since the projecting member is detachable, it can be dismounted according to need, for instance, when the construction machine is put in a delivery vehicle or the like for transportation, so that the transportability of the construction machine is not impaired. This enables it to equip construction machines of basic specification with the projecting member as an option and therefore, the projecting member is universally easily applicable to a wide range of construction machines from small to large sizes.

To sum up, the invention implements a construction machine and a projecting member thereof, which provide a light-weight inexpensive structure for keeping an operator's cab space that allows the operator to work to repair and recover the construction machine in case of tumbling and which does not impair the visibility of the operator's cab.

BEST MODE FOR CARRYING OUT THE INVENTION

Figure 1:
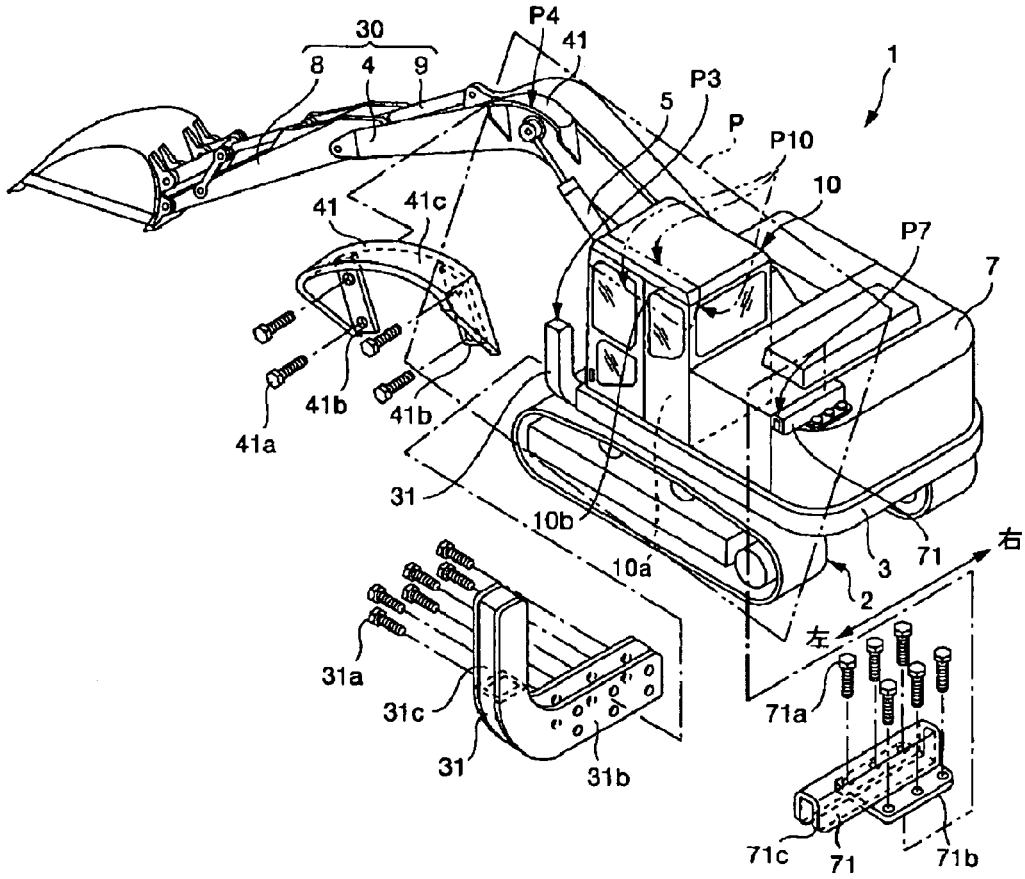
FIG. 1 is a perspective view of a construction machine according to a first embodiment of the invention.

Referring now to FIGS. 1 to 12, preferred embodiments of the construction machine of the invention will be hereinafter described, taking hydraulic excavators for example.

A first embodiment will be described with reference to FIG. 1. A hydraulic excavator 1 has a revolving superstructure frame 3 that is mounted on a lower traveling structure 2 through a swivel 16 (see FIG. 7) so as to freely turn around upon it. There are provided, on the revolving superstructure frame 3, (i) a boomerang-like boom 4 for a work implement 30 that is located at a cross-wise mid position of the front part of the frame 3; (ii) an engine, a group of control valves, a fuel tank, an operating oil tank (these are not shown) and a counterweight 7 that are located in the rear part of the frame 3; and (iii) an operator's cab 10 located at either the right or left side of the front part of the frame 3 (in the first embodiment, the operator's cab is located at the left side).

A projecting member 31 is attached to an end of the front face of the revolving superstructure frame 3 which end is located on the side of the operator's cab and is a welded structure composed of a base end portion 31*b* that serves as an attaching part and a vertical supporting portion 31*c* that is curved from the base end portion 31*b* so as to extend upwardly. The vertical supporting portion 31*c* extends along the side face of the operator's cab 10, being spaced therefrom. The base end portion 31*b* is detachably attached with a specified number of bolts 31*a*. The cross-sectional shape of the projecting member 31 is not necessarily limited to rectangles such as shown in this embodiment but may be circular. A projecting member 41 is attached to the boomerang-shaped boom 4 at a length-wise mid position that becomes the highest position when the boom 4 is in an ordinary excavation posture (concretely, the length-wise mid position is the portion of the boom 4 that is curved or rounded upward). The projecting member 41 is a welded structure sticking out from its base end portions (each serving as an attaching part) in a lateral direction of the operator's cab 10. In this embodiment, the projecting member 41 is formed such that a U-shaped member 41*c* is welded to the upper parts of front and rear attaching parts 41*b* thereby ensuring high rigidity, and the front and rear attaching parts 41*b* are detachably attached, by means of a specified number of bolts 41*a*, to the side face of the boom 4 which side face is located on the side of the operator's cab 10.

A projecting member 71 is mounted on the upper face of the counterweight 7, being positioned at the end on the same side as the operator's cab 10. The projecting member 71 is a welded structure overhanging outward (leftward in this embodiment) from a base end and constructed such that an opening end of a horizontal member 71*c* of U-shaped cross-section is welded to the upper face of a plate 71*b* that serves as an attaching part. The projecting member 71 is formed such that the horizontal member 71*c* projects in a lateral direction of the operator's cab 10 and the plate 71*b* is detachably bolted to the upper face of the counterweight 7 with a specified number of bolts 71*a*. The projecting members 31, 41, 71 are not necessarily formed from a welded structure but may be made by casting, forging or the like provided that the projecting members 31, 41, 71 have enough strength to sustain the load of the hydraulic excavator 1 in case of tumbling.

In the above-described structure, the respective leading ends P3, P4, P7 of the projecting members 31, 41, 71 define a virtual plane P. An operator's cab space 10*a*, which is located in an inner position of the vehicle body than the location of the intersecting line P10 of the virtual plane P and the operator's cab 10, provides a space large enough to allow the operator to work to repair and recover the construction machine 1 within the operator's cab 10 in case of overturning or tumbling. Although three projecting members 31, 41, 71 are provided in the first embodiment, the number of projecting members is not limited to this. In other words, at least any one of the three projecting members 31, 41, 71 is provided and the virtual plane P is defined by three points that are (i) the end of the revolving superstructure frame 3 which end is located on the side of the operator's cab 10 or the projecting member 31; (ii) the end of the boom 4 or the projecting member 41; and (iii) the end of the counterweight 7 or the projecting member 71. The virtual plane P should meet the condition in which the operator's cab space 10*a*, which is located in the inner position compared to the virtual plane P, is large enough to allow the operator to work to repair and recover the construction machine 1 within the operator's cab 10.

The structure of the first embodiment has the following effect. If the hydraulic excavator 1 tumbles, the hydraulic excavator 1 will be supported at three points that are the projecting member 31 provided at the end of the revolving superstructure frame 3 which end is located on the side of the operator's cab 10, the projecting member 41 provided at the end of the boom 4 and the projecting member 71 provided at the end of the counterweight 7. In this case, although the virtual plane P defined by these three points (the leading ends P3, P4, P7 of the projecting members 31, 41, 71 in the first embodiment) comes into contact with the ground, only an operator's cab space 10*b* which projects outward from the virtual plane P is deformed so that the operator's cab space 10*a*, which is located in the inner position of the vehicle body 10 compared to the virtual plane P, can be safely kept. In this way, deformation of the operator's cab 10 can be limited by the proper configurations and mounting positions of the projecting members 31, 41, 71.

Figure 2:
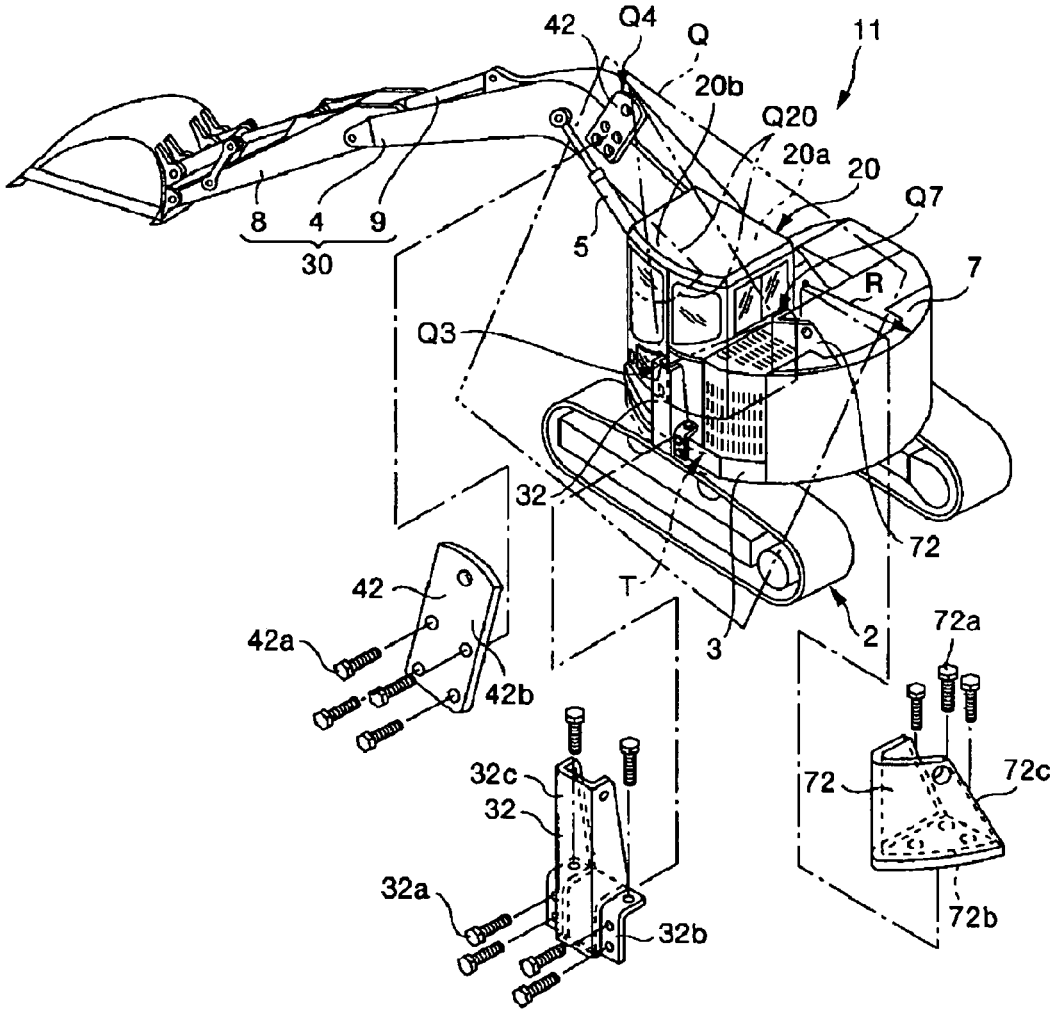
FIG. 2 is a perspective view of a construction machine according to a second embodiment of the invention.

Reference is made to FIG. 2 to describe a second embodiment. The second embodiment is associated with an application of the invention to a small trail radius hydraulic excavator 11. The small trail radius hydraulic excavator 11 is designed such that the turning trajectory T (turning radius=R) of the trail end largely falls within the maximum outer width (lateral length) of the traveling system. The hydraulic excavator 11 is formed such that the revolving superstructure frame 3 is mounted on the lower traveling structure 2 through the swivel so as to be freely turnable. There are provided, on the revolving superstructure frame 3, (i) the boomerang-like boom 4 disposed at a cross-wise mid position of the front part of the frame 3; (ii) the counterweight 7 disposed at the rear part of the frame 3; and (iii) an operator's cab 20 disposed at either the right or left side of the front part of the frame 3 (in the second embodiment, the operator's cab is located at the left side).

A projecting member 32 is disposed at an end of the revolving superstructure frame 3 which end is located at a transverse side of the operator's cab 20 (in the second embodiment, the left side of the operator's cab 20). The projecting member 32 is located within the turning radius R of the revolving superstructure frame 3. The projecting member 32 is a welded structure formed such that a supporting member 32*c* of U-shaped cross-section is welded to a base end member 32*b* serving as an attaching part, so as to project upward, and such that the base end member 32*b* is detachably bolted to the revolving superstructure frame 3 with a specified number of bolts 32*a*. A projecting member 42, which is composed of an upwardly projecting plate 42*b*, is detachably bolted to the boom 4 with a specified number of bolts 42*a*. Preferably, the projecting member 42 is disposed in the vicinity of a substantially length-wise mid position that becomes the highest position when the boomerang-like boom 4 is in an ordinary excavation posture (concretely, the length-wise mid position is the portion of the boom 4 that is curved or rounded upward).

A projecting member 72 is attached to an end of the upper face of the counterweight 7 which end is located on the same side as the operator's cab. The projecting member 72 is formed such that a supporting member 72*c* produced by bending is welded, in an upright fashion, to two outer peripheral edges of a substantially triangular plate 72*b* that serves as an attaching part. The plate 72*b* is detachably bolted by use of a specified number of bolts 72*a*, with the supporting member 72*c* projecting upward. It should be noted that the projecting members 32, 42, 72 are not necessarily formed from a welded structure but may be made by casting, forging or the like.

A virtual plane Q is defined by the leading ends Q3, Q4, Q7 of the projecting members 32, 42, 72. An operator's cab space 20*a*, which is located in an inner position than the location of the intersecting line Q20 of the virtual plane Q and the operator's cab 20, is large enough to allow the operator to work to repair and recover the construction machine 11 within the operator's cab 20 in case of overturning or tumbling. Although three projecting members 32, 42, 72 are provided in the second embodiment, the number of projecting members is not limited to this. In other words, at least any one of the three projecting members 32, 42, 72 is provided and the virtual plane Q is defined by three points that are (i) the end of the revolving superstructure frame 3 which end is located on the transverse side of the operator's cab 20 or the projecting member 32 provided at this end; (ii) the end of the boom 4 or the projecting member 42 provided at this end; and (iii) the end of the counterweight 7 or the projecting member 72 provided at this end. The virtual plane Q should satisfy the condition in which the operator's cab space 20*a*, which is located in the inner position compared to the virtual plane Q, is large enough to allow the operator to work to repair and recover the construction machine 11 within the operator's cab 20.

Figure 3:
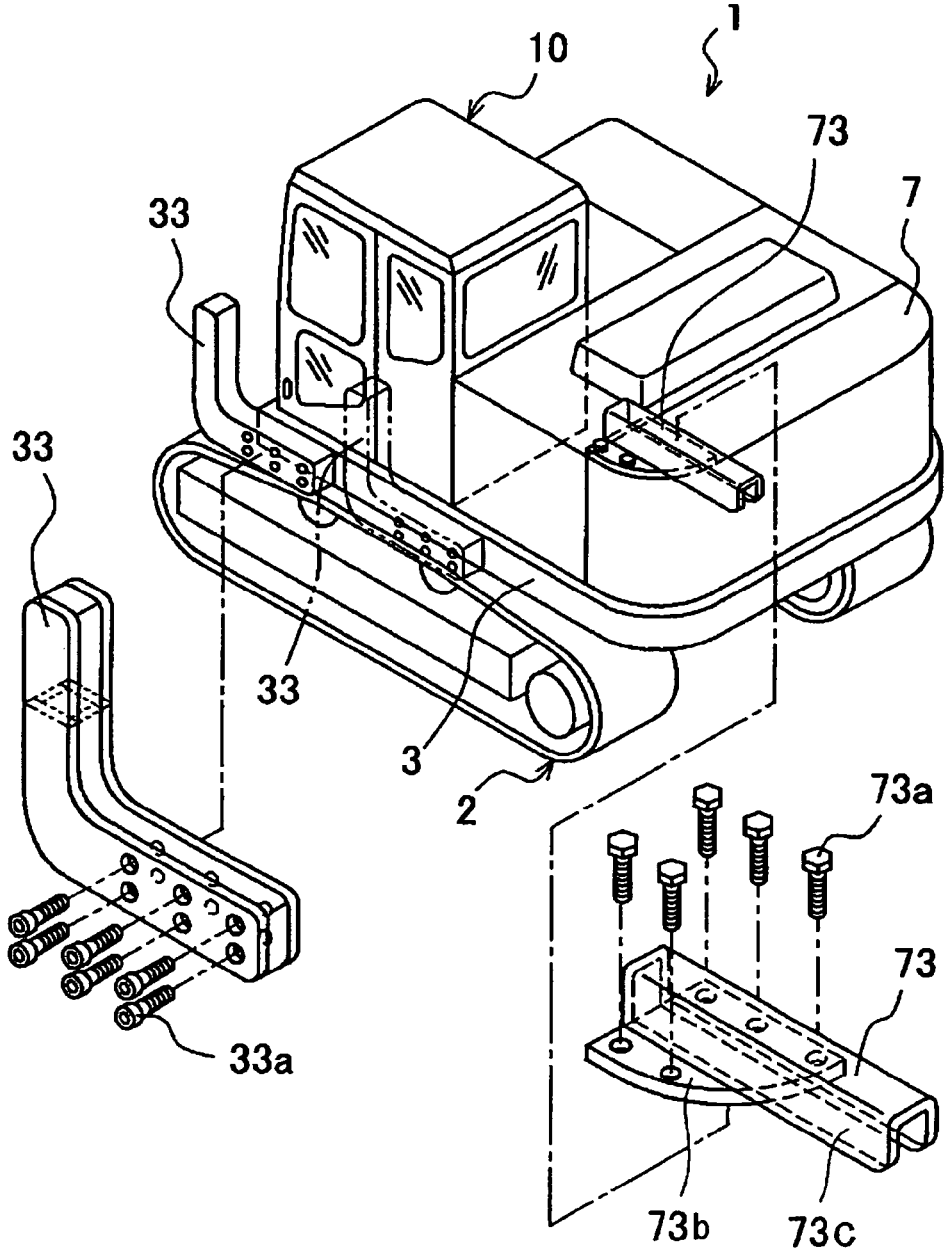
FIG. 3 is a perspective view of a construction machine body according to third and fourth embodiments of the invention.

Reference is made to FIG. 3 to describe third and fourth embodiments. The third embodiment is associated with another embodiment of the projecting member disposed on the transverse side of the operator's cab 10. The projecting member of this embodiment is constructed so as to easily selectively take two positions. One is a position which puts much value on visibility required according to the actual condition of the job site or on the convenience of the operator getting on and off. The other position puts much value on keeping of the maximum possible inner space of the operator's cab 10 in case of tumbling of the construction machine. Specifically, a projecting member 33 having an L shape in a side view is made of a welded structure that is composed of a horizontal base end portion serving as an attaching part and an upright portion extending upward. The base end portion of the projecting member 33 is detachably bolted to a transverse side of the revolving superstructure frame 3 by use of a specified number of bolts 33*a*, such that the leading end of the upright portion projects outwardly from the vehicle body in an upward direction. In order to enable selective attachment of the projecting member 33 between two positions, that is, a front position and a rear position (indicated by chain double-dashed line), a plurality of mounting bolt holes are provided in each of the front position and the rear position.

According to the third embodiment, the same functions and effects as of the first and second embodiments can be achieved. Further, since the third embodiment makes it possible to easily selectively change the mounting position of the projecting member 33 which projects sideward and upward from the revolving superstructure frame 3, visibility in compliance with the actual condition of the job site and the convenience of the operator getting on and off can be ensured whereas the maximum possible operator's cab space can be kept in case of tumbling of the construction machine.

The fourth embodiment is associated with another embodiment of the projecting member disposed at the end of the counterweight 7. To eliminate an influence upon the transportability of the construction machine by avoiding an increase in vehicle width, a projecting member 73, which projects rearward from the counterweight 7, is disposed on the upper face of the counterweight 7 on the same side as the operator's cab. The projecting member 73 is a welded structure composed of a plate-like base end member 73*b* serving as an attaching part and a supporting member 73*c* of U-shaped cross-section which is welded to the upper face of the base end member 73*b*, with the opening end of the member 73*c* down, such that the supporting member 73*c* takes the form of a rectangular column extending in a horizontal direction. The projecting member 73 is arranged such that the leading end of the supporting member 73*c* projects rearward from the counterweight 7 and the base end member 73*b* is detachably bolted to the upper face of the counterweight 7 with a specified number of bolts 73*a*. The projecting member 73 is disposed so as not to stick out from the vehicle body in a widthwise direction.

Figure 4:
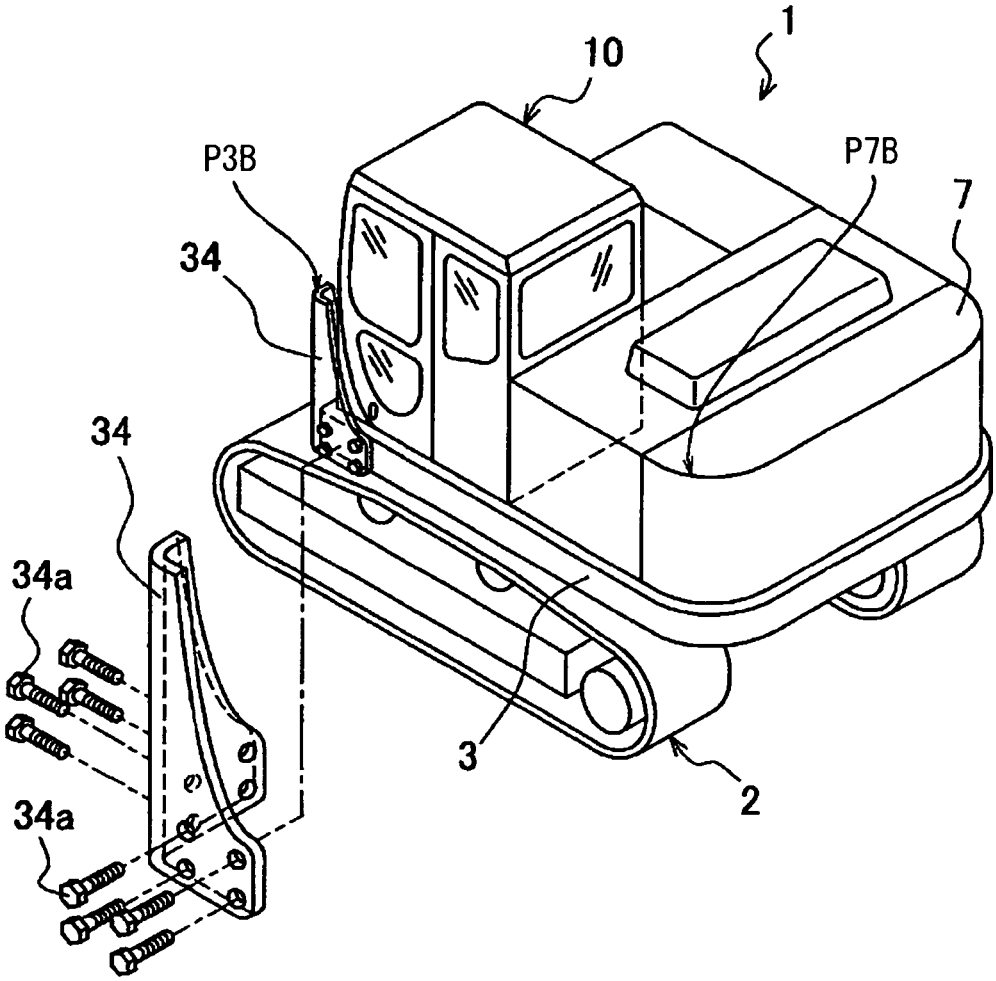
FIG. 4 is a perspective view of a construction machine body according to a fifth embodiment of the invention.

Reference is made to FIG. 4 to describe a fifth embodiment. According to the fifth embodiment, a projecting member 34 having an L-shaped cross-section in plan is attached to a corner of the revolving superstructure frame 3 which corner is located on the side of the operator's cab 10. The projecting member 34 projects upward from the revolving superstructure frame 3 and is detachably bolted, at its base end that serves as an attaching part, to the corner by use of a specified number of bolts 34*a*. In the fifth embodiment, the leading end P3B of the projecting member 34, an end 7B of the counterweight 7 which end is located on the same side as the operator's cab 10 and the leading end P4 (see FIG. 1) of the projecting member 41 of the boom 4 define a virtual plane (not shown). The projecting length of the projecting member 34 meets the condition in which the operator's cab 10 space, which is located in the inner position compared to the location of the intersecting plane of the virtual plane and the operator's cab 10, is large enough to allow the operator to work to repair and recover the construction machine 1 within the operator's cab 10 in case of tumbling.

Figure 5:
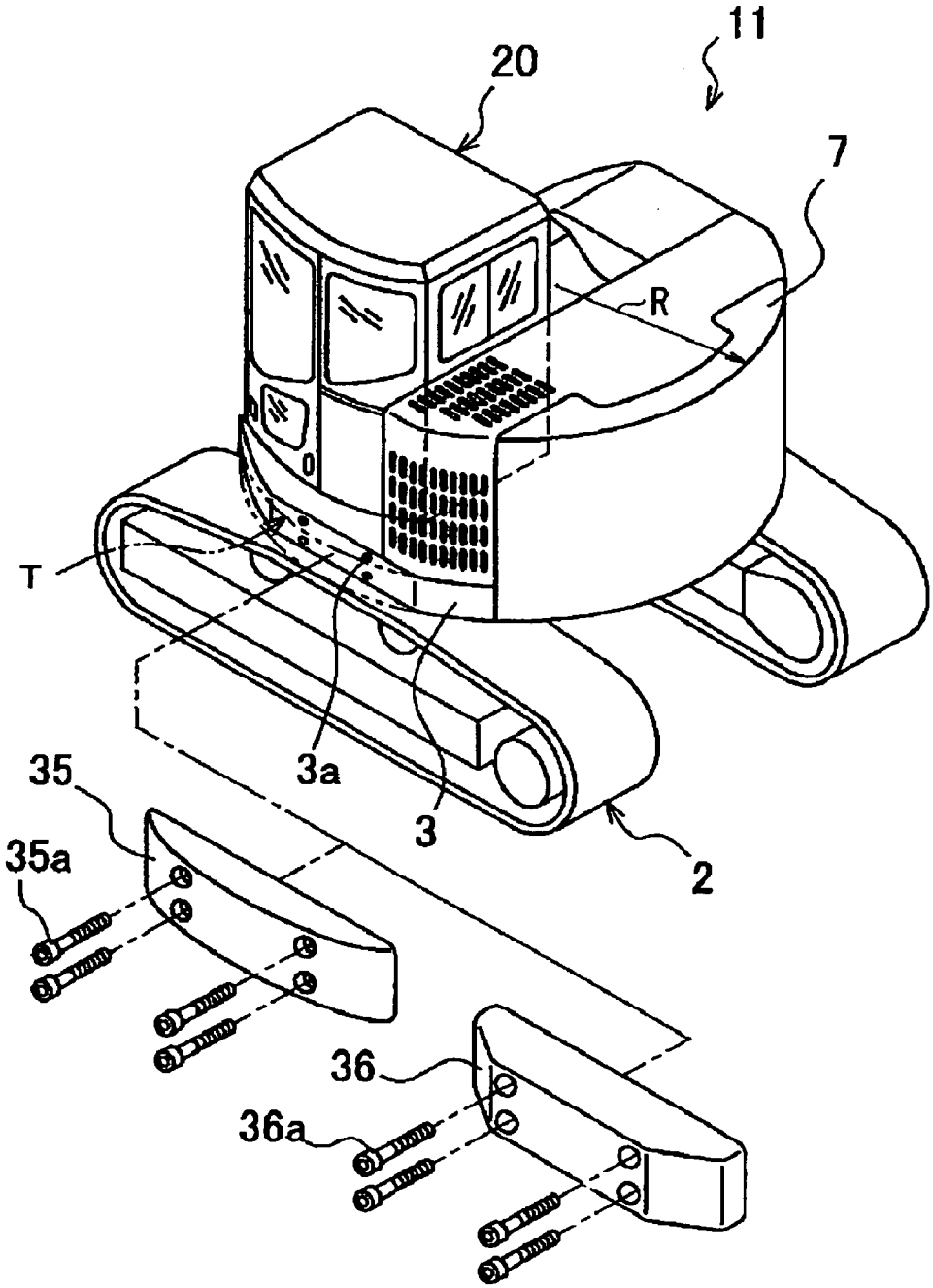
FIG. 5 is a perspective view of a construction machine body according to sixth and seventh embodiments of the invention.

With reference to FIG. 5, sixth and seventh embodiments will be described. The sixth and seventh embodiments each provide another embodiment of the projecting member that is attached to a side face of the revolving superstructure frame 3, projecting outward in a transverse direction, the side face being located on the transverse side of the operator's cab 20. The side face of the revolving superstructure frame 3, which is located on the transverse side of the operator's cab 20, is provided with screw holes 3*a*. In the sixth embodiment, in order that a projecting member 35 is attached so as to project sideward from the side face of the revolving superstructure frame 3 on the side of the operator's cab 20, while restricting an increase in the turning radius R of the small trail radius hydraulic excavator 11 not to impair the operability, the projecting member 35, which projects sideward within the turning radius R of the revolving superstructure frame 3, is bolted by screwing bolts 35*a* into the screw holes 3*a*.

In the seventh embodiment, in order to easily attach and detach a projecting member 36 having a sufficient amount of sideward projection according to need, the projecting member 36, which projects sideward beyond the turning radius R of the revolving superstructure frame 3, is bolted by screwing bolts 36*a* into the screw holes 3*a*. The projecting members 35, 36 may be formed of, for instance, a welded structure, cast part or forged part.

Figure 6:
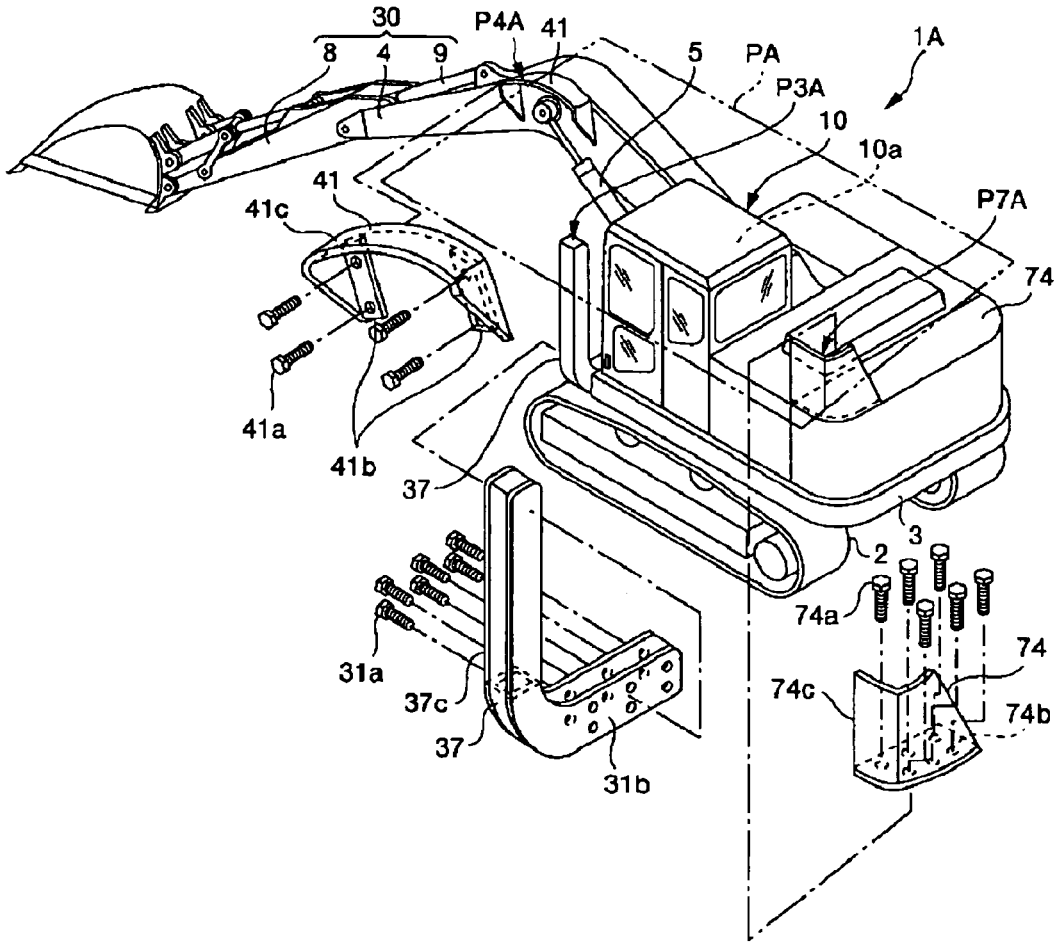
FIG. 6 is a perspective view of a construction machine according to an eighth embodiment of the invention.
Figure 7:
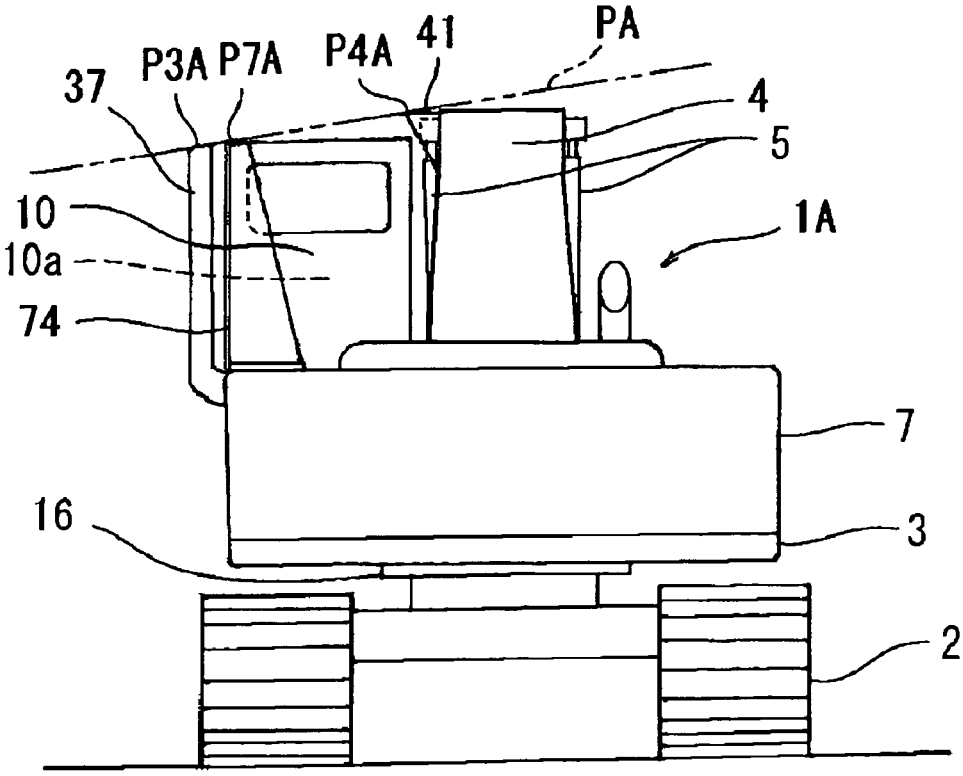
FIG. 7 is a rear view of the construction machine shown in FIG. 6.

With reference to FIGS. 6 and 7, an eighth embodiment will be described. Similarly to FIG. 1, a hydraulic excavator 1A is formed such that the revolving superstructure frame 3 is mounted on the lower traveling structure 2 through the swivel 16 so as to be freely turnable. The boomerang-like boom 4 is mounted on the upper face of the front part of the revolving superstructure frame 3. The counterweight 7 is mounted on the upper face of the rear part of the revolving superstructure frame 3. The operator's cab 10 is mounted on the upper face of the left front part of the revolving superstructure frame 3.

A projecting member 37 attached to the end of the front face of the revolving superstructure frame 3 which end is located on the side of the operator's cab is formed from substantially the same welded structure as of the projecting member 31 illustrated in FIG. 1. The vertical length of a vertical supporting member 37*c* of the projecting member 37 is much longer than the vertical supporting member 31*c* of the projecting member 31. The vertical supporting member 37*c* extends along the side face of the operator's cab 10, being spaced therefrom. A base end portion 31*b* is detachably bolted, using a specified number of bolts 31*a*. Similarly to the projecting member 41 illustrated in FIG. 1, the projecting member 41 of the eighth embodiment attached to the position of the boomerang-shaped boom 4 which becomes the highest when the boom 4 is in an ordinary excavation posture is a welded structure projecting from its base end portion in a lateral direction of the operator's cab 10.

A projecting member 74 mounted on the counterweight 7 is a welded structure that sticks out from its base end portion (in an upward direction in the eighth embodiment). The projecting member 74 is formed such that a supporting member 74*c* having an L shape in top view is welded, in an upright manner, to the outer peripheries of the left and rear parts of a plate 74*b* that serves as an attaching part. The plate 74*b* is detachably bolted to the upper face of the counterweight 7 by means of a specified number of bolts 74*a*. The projecting members 37, 41, 74 are not necessarily formed from a welded structure but may be formed, for instance, by casting or forging. The projecting members 37, 41, 74 should have enough strength to sustain the load of the hydraulic excavator 1A in case of tumbling.

In the above structure, a virtual plane PA defined by the leading ends P3A, P4A, P7A of the projecting members 37, 41, 74 has no parts that intersect the operator's cab space 10*a*. More concretely, the virtual plane PA does not intersect the operator's cab space 10*a*. Therefore, the operator's cab space 10*a* is large enough to allow the operator to work to repair and recover the construction machine 1A within the operator's cab 10 of the construction machine 1A in case of overturning or tumbling. The eighth embodiment uses at least the projecting members 37, 74 and the virtual plane PA of the eighth embodiment is defined by three points that are (i) the leading end P3A of the projecting member 37, (ii) the leading end P7A of the projecting member 74 and (iii) the end of the boom 4 or the leading end P4A of the projecting member 41 disposed at this end. The end of the boom 4 mentioned above is a position where the projecting member 41 is not provided and corresponds to the mounting position for the projecting member 41 such as shown in FIG. 6.

Figure 8:
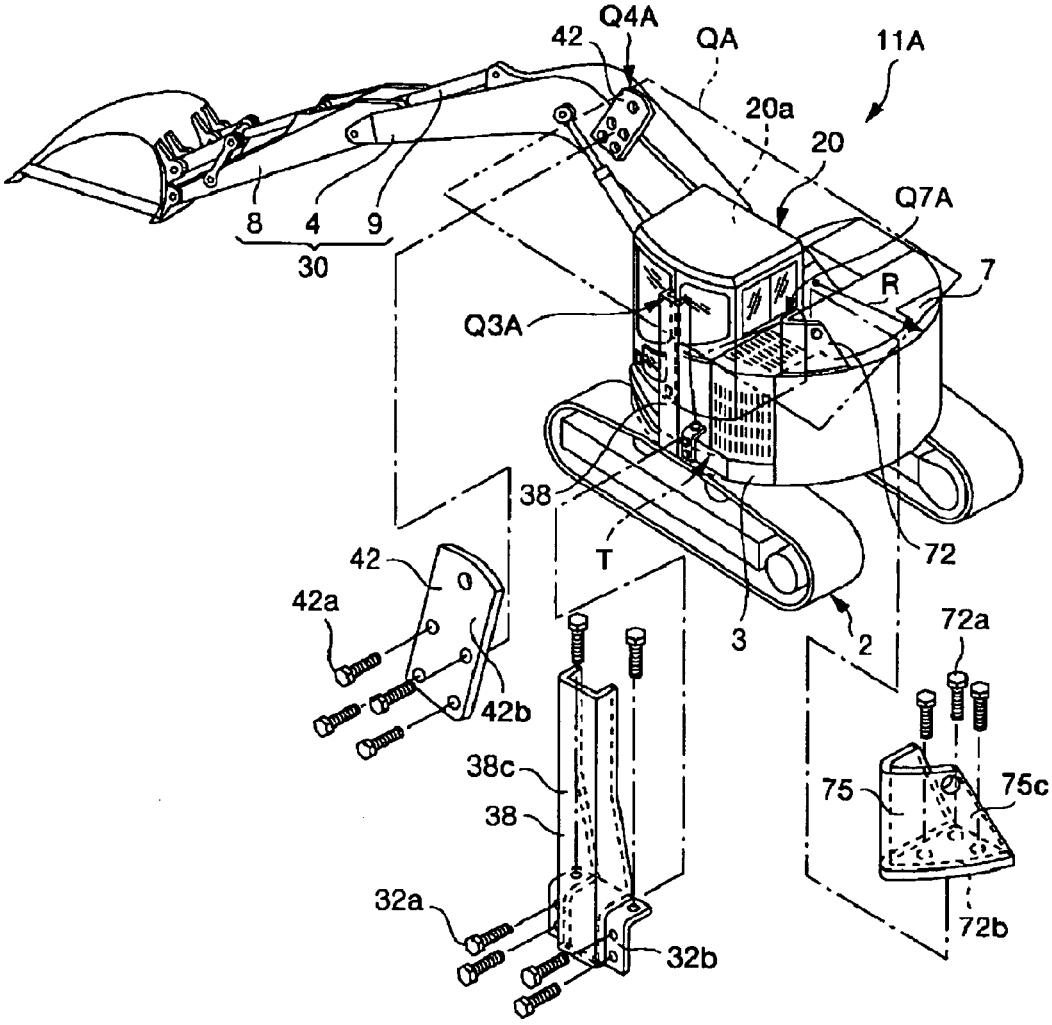
FIG. 8 is a perspective view of a construction machine according to a ninth embodiment of the invention.

With reference to FIG. 8, a ninth embodiment will be described. Similarly to the second embodiment, the ninth embodiment is associated with an example in which the invention is applied to a small trail radius hydraulic excavator 11A. The hydraulic excavator 11A has a projecting member 38 that is attached to an end of the revolving superstructure frame 3 which end is located on the left side of the operator's cab 20 in a rear view of the vehicle body and located within the turning radius R of the revolving superstructure frame 3. The projecting member 38 is a welded structure having substantially the same construction as of the projecting member 32 illustrated in FIG. 2. The vertical length of a supporting member 38*c* of the projecting member 38 is longer than the supporting member 32*c* of the projecting member 32. The boomerang-like boom 4 is provided with the projecting member 42 which is detachably attached thereto so as to project more upwardly than the projecting member 42 illustrated in FIG. 2. Like the foregoing embodiment, the projecting member 42 is preferably disposed in the vicinity of a substantially length-wise mid position that becomes the highest position when the boom 4 is in an ordinary excavation posture. A projecting member 75 is attached to an end of the upper face of the counterweight 7 which end is on the same side as the operator's cab 20 (the projecting member 75 is located at a position opposed to the rear face of the operator's cab 20). The projecting member 75 is a welded structure substantially similarly constructed as the projecting member 72 illustrated in FIG. 2. The vertical length of a supporting member 75*c* of the projecting member 75 is longer than that of the supporting member 72*c* of the projecting member 72. The projecting members 38, 42, 75 are not limited to a welded structure but may be formed by casting, forging etc.

A virtual plane QA defined by the leading ends Q3A, Q4A, Q7A of the projecting members 38, 42, 75 has no parts that intersect the operator's cab space 20*a* of the operator's cab 20 (see the virtual plane PA shown in FIG. 7). Therefore, the operator's cab space 20*a* is large enough to allow the operator to work to repair and recover the overturned or tumbled construction machine 11A within the operator's cab 20 of the construction machine 11A. The ninth embodiment uses at least the projecting members 38, 75 and the virtual plane QA of the ninth embodiment is defined by three points that are (i) the leading end Q3A of the projecting member 38, (ii) the leading end Q7A of the projecting member 75 and (iii) the side edge of the boom 4 or the leading end Q4A of the projecting member 42 disposed at this side edge. The side edge of the boom 4 just mentioned above is a position of the boom 4 where the projecting member 42 is not provided and corresponds to the mounting position for the projecting member 42 such as shown in FIG. 8.

Figure 9:
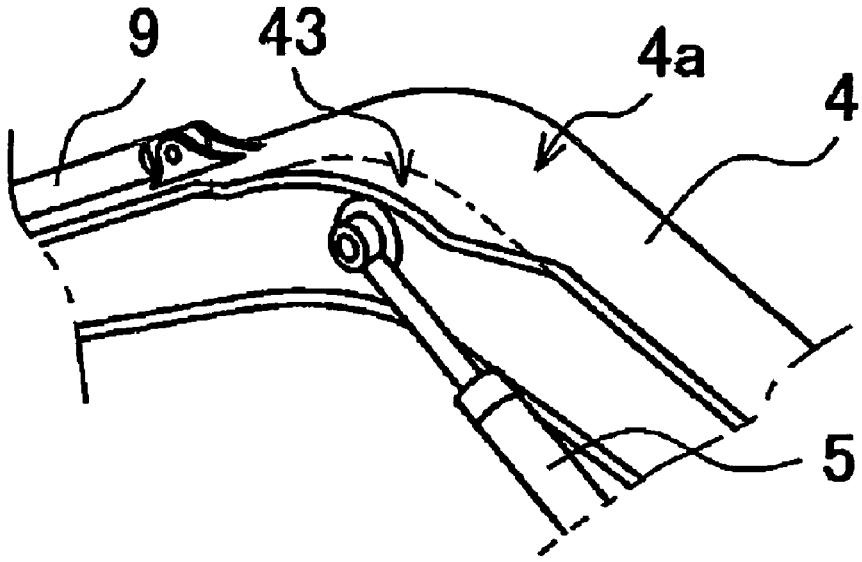
FIG. 9 is an explanatory view illustrating a fundamental part of a boom of a construction machine according to a tenth embodiment of the invention.

Reference is made to FIGS. 9 to 12 to describe tenth to thirteenth embodiments each providing another example of the projecting member attached to the end of the boom 4. In the tenth embodiment, a part of an upper face plate 4*a* of the boom 4 sticks out in a lateral direction of the operator's cab as shown in FIG. 9, thereby providing the boom 4 with a projecting member 43 that projects sideward. The projecting member 43 is preferably disposed in the vicinity of a substantially length-wise mid position that becomes the highest position when the boom 4 is in an ordinary excavation posture (concretely, the length-wise mid position is the portion of the boom 4 that is curved or rounded upward).

Figure 10:
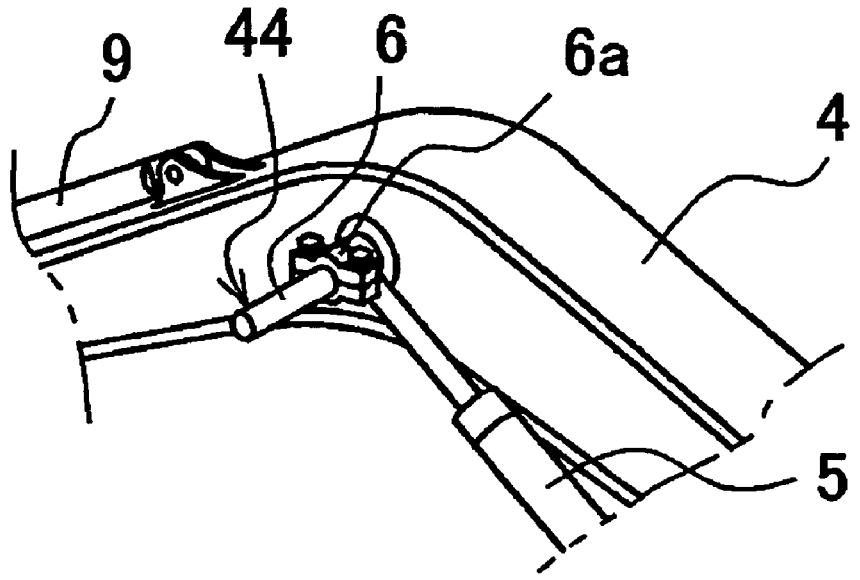
FIG. 10 is an explanatory view illustrating a fundamental part of a boom of a construction machine according to an eleventh embodiment of the invention.

In the eleventh embodiment, the boom 4 is provided, as shown in FIG. 10, with a pin 6 for attaching a lifting/lowering hydraulic cylinder 5. The pin 6 is attached so as to project in a lateral direction of the operator's cab more than a retainer 6*a* for preventing the hydraulic cylinder 5 from coming off. The pin 6 constitutes a projecting member 44 that projects sideward.

Figure 11:
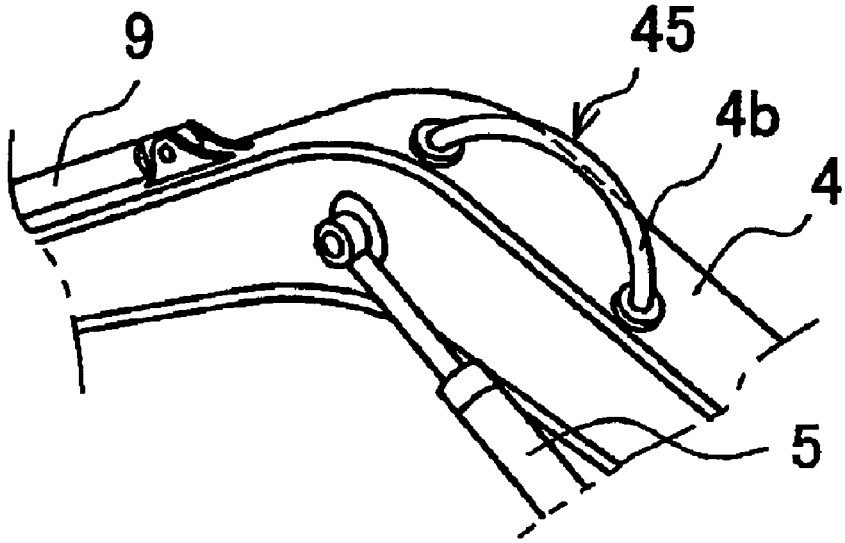
FIG. 11 is an explanatory view illustrating a fundamental part of a boom of a construction machine according to a twelfth embodiment of the invention.

In the twelfth embodiment, a projecting member 4*b* formed by arcuately bending a pipe is welded, as shown in FIG. 11, to the upper face of the boom 4. The projecting member 4*b* is attached to an end that is on the side of the operator's cab and behind the position curved or rounded upward. Thereby, a projecting member 45 is formed which projects upward or rearward from the boom 4. The projecting member 4*b* is not necessarily limited to the shape and material described above, but may be formed from a rectangular pipe, round bar or the like. In addition, the mounting position is not limited to the upper face of the boom 4. The projecting member 45 may be welded to a side face of the boom 4. Further, the means for connecting the boom 4 to the projecting member 45 is not limited to welding but may be attachment by use of bolts (not shown) or the like.

Figure 12:
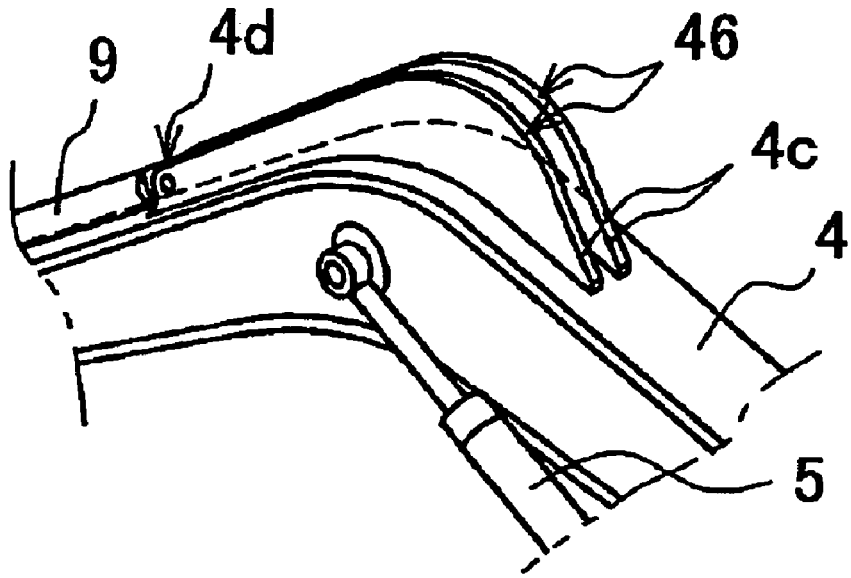
FIG. 12 is an explanatory view illustrating a fundamental part of a boom of a construction machine according to a thirteenth embodiment of the invention.
Figure 13:
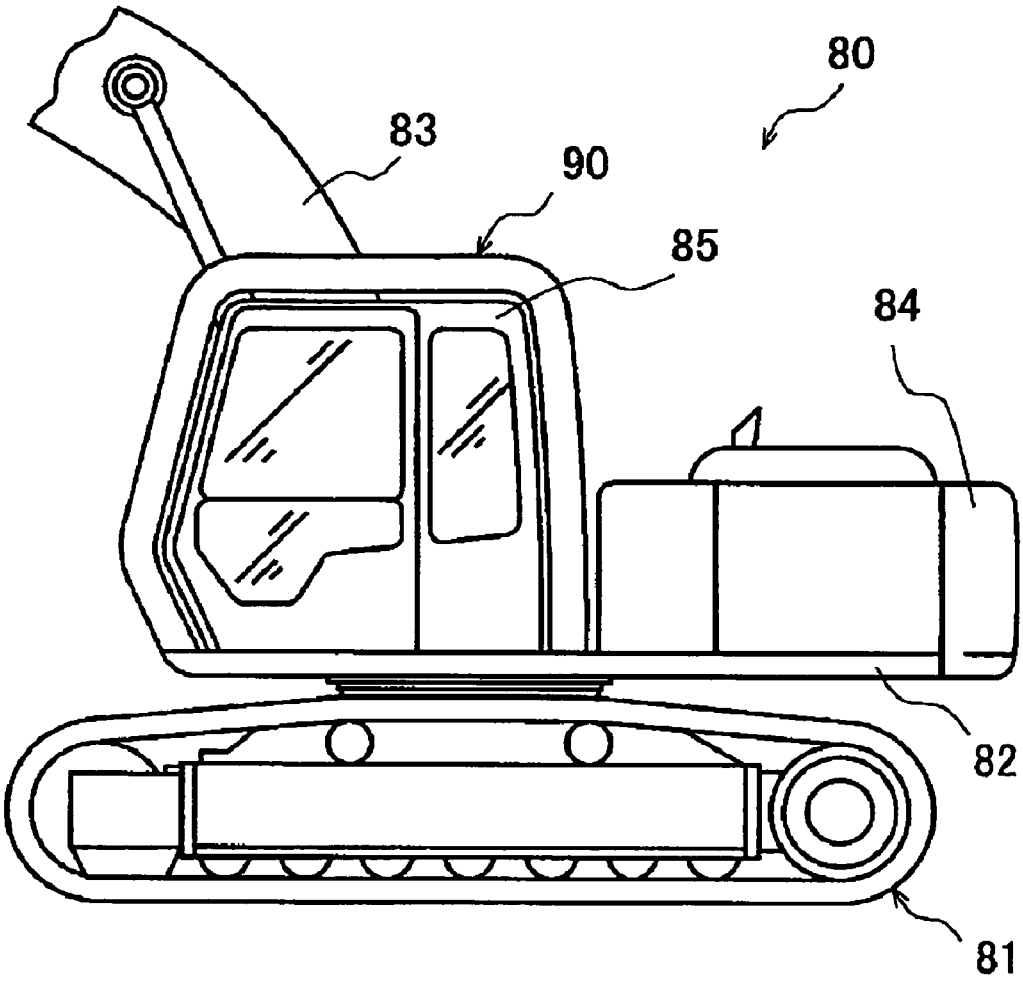
FIG. 13 is a side view of a hydraulic excavator which is one example of the construction machine disclosed in Second Example of the prior art.
Figure 14:
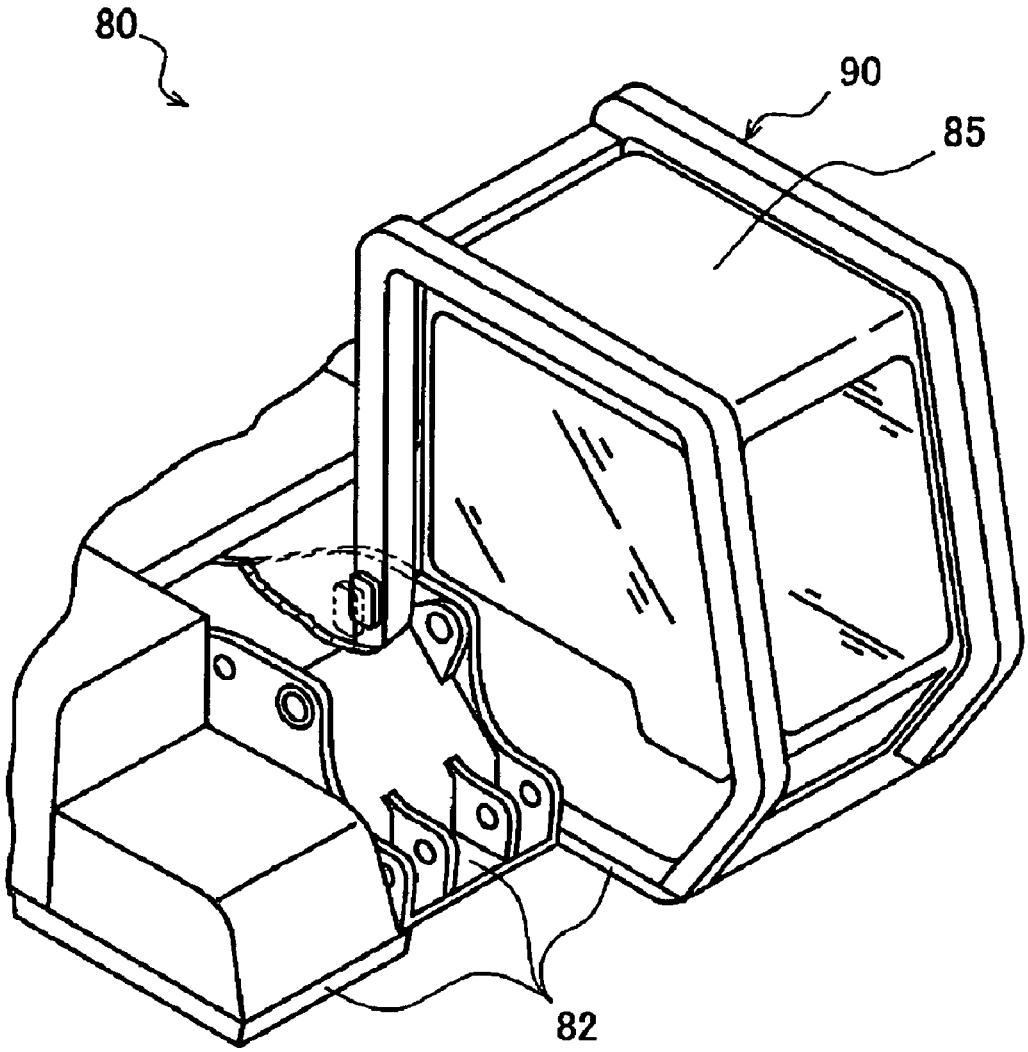
FIG. 14 is a partially broken perspective view illustrating a fundamental part of the hydraulic excavator shown in FIG. 13.

In the thirteenth embodiment, a right and left pair of plates 4*c* are attached, as shown in FIG. 12, to the upper face of the boom 4 so as to face each other in an upright condition. The front parts of the plates 4*c* are used as a bracket 4*d* for attaching a hydraulic cylinder 9 for driving an arm 8 (see FIGS. 1, 2, 6, 8), whereas the rear parts are used as projecting members 46 that project upward from the boom 4.

With the structures of the tenth to thirteenth embodiments, the same functions and effects as of the first to fourth embodiments can be attained. In addition, the projecting members 43, 44 that project sideward from the boom 4 and the projecting members 45, 46 that project upward can be manufactured as lightweight members at low cost.

In the structures of the first to thirteenth embodiments, the projecting members 31 to 38 disposed at the end of the revolving superstructure frame 3, the projecting members 41 to 46 disposed at the end of the boom 4 and the projecting members 71 to 75 disposed at the end of the counterweight 7 may be selectively employed in a desired combination. The mounting positions for these projecting members may be selected from three positions, i.e., the revolving superstructure frame 3, the boom 4 and the counterweight 7. Although the projecting members 31 to 38, projecting members 41 to 42 and projecting members 71 to 75 are detachably mounted in the above description, these projecting members are not limited to this but may be integrally formed with the revolving superstructure frame 3, the boom 4 and the counterweight 7 respectively, by means of welding, casting or the like.

As a result, in a construction machine wherein a revolving superstructure frame is mounted on a lower traveling structure through a swivel so as to be freely turnable and wherein the upper face of the revolving superstructure frame is provided with a boom mounted on its front part, a counterweight mounted on its rear part and an operator's cab mounted on either the right or left side of the front part, it is possible to restrict deformation of the operator's cab by use of projecting members of simple configuration in case of tumbling of the construction machine. This enables it to arrange and produce a lightweight, low-cost protective structure for the operator's cab, which keeps an operator's cab space for the operator to work to repair and recover the tumbled construction machine.

In addition, this structure is easy to apply to a variety of small-sized and middle-sized construction machines so that it has a wide range of applications.

While the embodiments of the construction machine of the invention have been described hereinabove in the context of a hydraulic excavator, the application of the invention is not necessarily limited to a hydraulic excavator but the invention may be universally applicable to other types of construction machines in the same way as described earlier. Where the invention is applied to other types of construction machines, the same functions and effects as of the above description can be attained.

INDUSTRIAL APPLICABILITY

The invention provides a useful construction machine and projecting member thereof which can be manufactured at low production cost and carry out restriction of deformation of the operator's cab without impairing visibility in the event of tumbling of the construction machine.

The invention claimed is:

1. A construction machine comprising:

a lower traveling structure;

a revolving superstructure frame mounted on the lower traveling structure via a swivel so as to be freely turnable;

a work implement, which comprises a boomerang-shaped boom, mounted on the revolving superstructure frame substantially at a cross-wise middle position of a front part of the revolving superstructure frame;

a counterweight mounted on the revolving superstructure frame at a rear part of the revolving superstructure frame; and an operator's cab mounted on the revolving superstructure frame at one of a right side and a left side of the front part of the revolving superstructure frame, a first projecting member which projects upward, and which is attached to a front face of the revolving superstructure frame at a same side of the revolving superstructure frame as the operator's cab;

a second projecting member which is provided at a vertex of the boomerang shape of the boom;

a third projecting member which is provided on an upper face of the counterweight at a same side of the construction vehicle as the operator's cab;

wherein a virtual plane is defined by three points, which are provided at the first projecting member, the second projecting member, and the third projecting member, respectively; and wherein an operator's cab space is positioned closer to a body of the construction machine than the virtual plane.

* * * * *